United States Patent [19]

Davis

[11] 4,362,274

[45] Dec. 7, 1982

[54] DUAL FUEL ATOMIZER

[75] Inventor: Albert W. Davis, Tahoe City, Calif.

[73] Assignee: Coen Company, Inc., Burlingame, Calif.

[21] Appl. No.: 163,556

[22] Filed: Jun. 27, 1980

[51] Int. Cl.[3] ..... F23D 11/16

[52] U.S. Cl. ..... 239/419.3; 239/422; 239/424.5

[58] Field of Search ..... 239/419.3, 422, 424.5, 239/424, 419, 425, 423, 434.5, 427.5

[56] References Cited

U.S. PATENT DOCUMENTS 1,736,768 11/1929 Boynton ..... 239/422
2,303,648 12/1942 Lemster et al. ..... 239/419.3

FOREIGN PATENT DOCUMENTS 831864 4/1960 United Kingdom ..... 239/424
943223 12/1963 United Kingdom ..... 239/419.3

*Primary Examiner*—Bruce H. Stoner, Jr.
*Assistant Examiner*—Paul A. Sobel
*Attorney, Agent, or Firm*—Townsend and Townsend

[57] ABSTRACT

A nozzle is disclosed which is capable of simultaneously operating with two different liquid fuels, a first fuel being difficult, and a second fuel being relatively easy to ignite. The nozzle has concentric first, second and third conduits through which the first fuel, atomizing steam and the second fuel flow towards a nozzle cap. The steam is divided into two streams one of which is used to atomized the first fuel outside and downstream of the nozzle end while the second stream is used to atomized the second fuel inside the nozzle. The nozzle cap has openings for discharging the atomized second fuel in surrounding relationship to the first fuel to thereby generate a tubular frame with the second fuel that radiates heat inwardly, thereby facilitating the vaporization of the first fuel and its subsequent combustion.

13 Claims, 1 Drawing Figure

DUAL FUEL ATOMIZER

BACKGROUND OF THE INVENTION

Industrial burners fired with liquid fuels employ nozzles which atomize the liquid fuel before or as the fuel is discharged from the nozzle into a combustion chamber or the like. Typically, steam but sometimes compressed air or another compressed gas is combined with the liquid fuel so that the fuel is atomized into minute droplets suspended in the atomizing steam or gas. The atomized fuel is then discharged from the nozzle, ignited and combusted.

In some instances it is necessary to combust liquid fuels which are difficult to ignite. Such fuels may either represent a relatively inexpensive source of energy, e.g. a lower quality fuel, or they may constitute waste that needs to be incinerated. Frequently it is difficult to combust such fuels because they have relatively few volatiles that can be driven off at relatively low temperatures and which can then be ignited to raise the temperature of the remainder of the fuel to its combustion temperature. To effectively incinerate heavy fuels it is, therefore, necessary to discharge them into a combustion zone or chamber which has the requisite temperature. One such approach involves the provision of multiple burners, some of which are fired with conventional fuel oil, for example, to raise the temperature of the combustion zone while other burners discharge into the zone the waste fuel.

U.S. Pat. No. 3,414,198 discloses such an arrangement in which, within an industrial boiler, for example, some of the burners are fired with liquid waste fuels or the like having a relatively low heat value while other burners are fired with relatively high heat value fuels, e.g. with fuel oil. This patent further discloses to construct the burners so that they can be operated with either of the two fuels by replacing appropriate portions of the burners. The arrangement appears to be well suited for large installations, such as industrial boilers or steam generators in which relatively large amounts of heat must be generated. In such instances, the combustion chamber is relatively large and well heated and the waste fuels can be combusted therein without significant problems by appropriately atomizing them and discharging them into the chamber where the waste fuel droplets are quickly and adequately heated to sustain their combustion.

In installations in which much less heat is to be generated, or in instances where the primary concern is the incineration of waste fuels to circumvent problems that are encountered if such fuels are otherwise disposed of, the arrangement disclosed in the above-referenced patent is impractical because it would be necessary to construct a relatively large combustion chamber which must be uniformly heated to the temperature required to ignite the waste fuel. If the required temperatures are not reached the combustion of the waste fuel will be incomplete and fuel particles will be discharged as highly objectionable pollutants. Thus, there is presently a need for an efficient and preferably inexpensive device which permits the atomization and combustion of waste fuels and the like by heating such fuels to the required temperature with a minimum amount of the much more expensive primary fuel.

SUMMARY OF THE INVENTION

The present invention provides a nozzle adapted to simultaneously atomize two fuels, e.g. a first fuel which is relatively difficult to ignite and which frequently has a relatively higher viscosity (hereinafter frequently referred to as "waste fuel") such as residual oils, tars, sludges and combustible liquids often generated during a variety of chemical and a second fuel which is relatively easy to ignite and which frequently has a relatively lesser viscosity (hereinafter referred to as "primary fuel") such as standard fuel oil, liquid fuels having a relatively large proportion of hydrocarbon and the like. In accordance with the present invention, the two fuels are flowed independently through appropriate conduits towards a discharge end of the nozzle and a third conduit is provided through which a pressurized, fuel atomizing medium (hereinafter frequently referred to as "steam" but which may also be compressed air or any other suitable pressurized gas) is flowed. The steam flow is divided into separate branches, one for the waste fuel and the other for the primary fuel.

The waste fuel is discharged from the nozzle and steam is directed from the nozzle onto the discharged waste fuel flow for atomizing the latter downstream of the nozzle in the combustion zone. The primary fuel is atomized within the nozzle and is then discharged through appropriately positioned ports or discharge openings for ignition downstream of the nozzle in the combustion zone and in close proximity to the atomized waste fuel.

The flame generated by the primary fuel thus heats the atomized waste fuel which in turn speeds up the vaporization of volatiles therein and quickly heats the waste fuel to a point at which it can be ignited and fully combusted. The heat transfer from the primary fuel flame to the atomized waste fuel is greatly enhanced by discharging the atomized primary fuel so that it surrounds the waste fuel, that is by forming the primary fuel flame so it defines a tubular flame envelope within which the waste fuel is rapidly heated and then ignited in close proximity to the nozzle.

Thus, in the dual fuel atomizer arrangement of the present invention, the atomized waste fuel is enveloped within a flame. The enveloping flame does not need to be significantly larger than the space occupied by the atomized waste fuel. The need for heating relatively large combustion chambers, as was necessary in the arrangement disclosed in the above-referenced U.S. patent, for example, is thereby eliminated. Thus, waste fuels can be efficiently incinerated irrespective of the overall volume of available waste fuel or its end use or, for that matter, irrespective of the overall size of the combustion chamber. This adapts the arrangement of the present invention for large scale as well as small scale installations. From an energy balance point of view, maximum use can be made of the available waste fuel while the consumption of primary fuel can be kept to a minimum, either the minimum required to adequately heat the waste fuel or the amount of primary fuel necessary over and above the available waste fuel to generate the desired heat energy at the installation in question.

Aside from its operating efficiency, the present invention provides a nozzle which is rugged and simple and which requires a minimum of maintenance. Yet, the nozzle is relatively inexpensive to construct and install. Broadly speaking, such a nozzle has first and second conduits for independently flowing the waste and primary fuels, respectively, towards the discharge end of the nozzle. A pressurized fuel atomizing medium, e.g. steam flows in a third conduit towards the discharge end. Means fluidly connected with the third conduit defines first and second passages in which first and second streams of steam flow from the third conduit. Means cooperating with the passages is further provided for contacting the waste and primary fuels with the first and second steam streams, respectively, so that the steam streams cause the atomization of the respective fuels discharged by the conduits.

In a specific embodiment, the nozzle of the present invention has a body which defines concentric first, second and third conduits adapted to be connected with respective sources of a pressurized waste fuel, a pressurized primary fuel and a pressurized fuel atomizing medium, e.g. steam. A nozzle cap defines a discharge end of the nozzle including means for securing the cap to the body. The cap includes a first opening aligned with and in fluid communication with the first conduit, a second opening in fluid communication with the second conduit, and a third opening in fluid communication with the third conduit. Fluid-tight barriers on an upstream side of the cap are located between the first, second and third openings. The third ports terminate in orifices on a downstream side of the cap oriented to direct steam discharged by them into contact with the waste fuel discharged from the first opening to thereby effect the atomization of the waste fuel exteriorly and downstream of the nozzle cap. Within the nozzle means is provided for diverting a portion of the steam flowing through the third conduit in a generally radially outward direction into contact with the primary fuel so that the latter is atomized interiorly of the nozzle. Atomized primary fuel is then directed to the second opening for discharge therefrom. The second openings are arranged substantially concentrically about the first and second openings so as to form a generally tubular primary flame downstream of the nozzle cap which envelopes the waste fuel discharged from the nozzle whereby heat from the primary flame heats the waste fuel, facilitates its vaporization and thereby facilitates the combustion of relatively difficult to ignite fuels.

DESCRIPTION OF THE PREFERRED EMBODIMENTS

Figure 1:
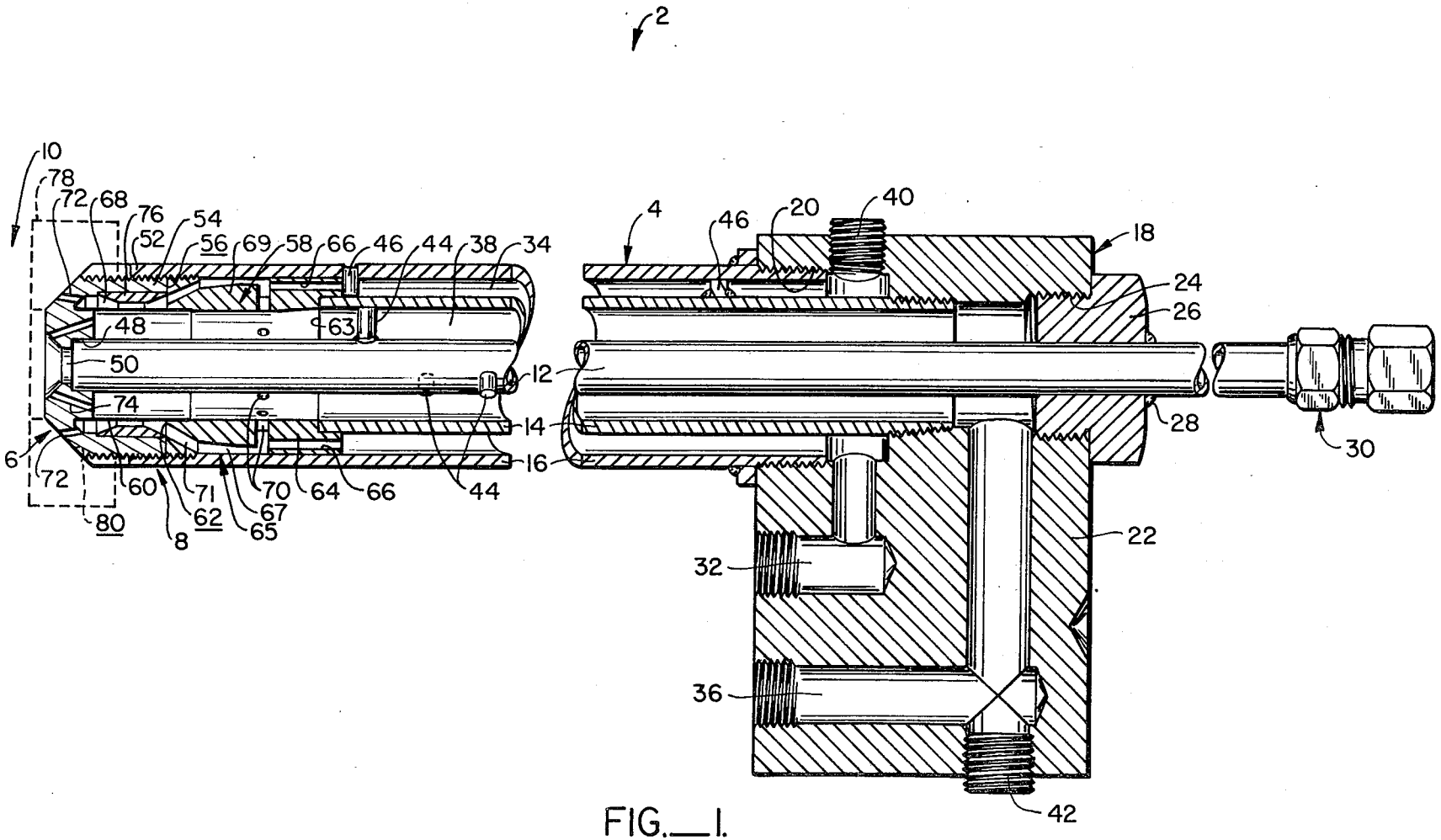
FIG. 1 is a side elevation view, in section, of the nozzle of the present invention.

Referring to the drawing, a nozzle 2 constructed in accordance with the invention generally comprises an elongated body 4 having a nozzle cap 6 at a downstream end of the nozzle which penetrates into a combustion zone 10 the exact construction of which is not material to the present invention and is, therefore, not illustrated. The nozzle body is defined by three concentric, elongated sections of pipe, an inner pipe 12, an intermediate pipe 14 and an outer pipe 16 which, generally speaking, extend forwardly from an aft end 18 of the nozzle to a fuel atomizing unit 8 at the downstream end of the nozzle shown in the left hand portion of FIG. 1. The aft ends of the intermediate and outer pipes 14, 16 are threaded into an appropriately stepped and threaded bore 20 of a base member 22. The stepped bore extends rearwardly (to the right as seen in FIG. 1) through the base member and terminates in a threaded end 24 which receives a matingly threaded plug 26 through which inner pipe 12 protrudes. The inner pipe is sealed to the plug, for example, with an annular weld 28, to prevent the escape of pressurized fluids past the plug as will be further described below. The inner pipe extends rearwardly past the plug and is provided with a suitable fitting 30 for connecting the pipe to a source of liquid, pressurized waste fuel.

Base member 22 includes a primary fuel intake 32 which is threaded for connection to a suitable fitting (not shown) and which leads into an annular space 34 between intermediate pipe 14 and outer pipe 16 through which primary fuel flows during operation. Base member 22 further has a steam inlet 36 which is also threaded to receive an appropriate fitting (not shown) for connection to a source of steam. The steam inlet leads to an annular space 38 between inner pipe 12 and intermediate pipe 14 through which steam flows during operation.

Plugs 40 and 42 sealingly close otherwise open portions of the primary fuel inlet 32 and the steam inlet 36 which are formed when portions of these passages are drilled into the base member.

Radially oriented lugs 44 are secured to a forward portion of the inner pipe and extend across the annular space 36 between the inner pipe and the outer pipe. They center the two pipes with respect to each other and provide a mutual support for them. Similarly, radially oriented lugs 46 similarly align and mutually support the intermediate pipe 14 and the outer pipe 16.

In use a relatively difficult to ignite waste fuel, say heavy, high viscosity residual oil, is flowed under pressure through inner pipe 12 for discharge into the combustion zone while a more readily ignitable primary fuel, say standard fuel oil, flows through inlet 32 and annular space 34 towards nozzle cap 6. Fuel atomizing steam enters through inlet 36 and flows through the annular space 38 between the inner and the intermediate pipes. In atomizing unit 8 this single atomizing steam flow is divided into separate streams for atomizing both fuels as follows.

The inner pipe 12 and the outer pipe 16 extend forwardly into contact with nozzle cap 6. The inner pipe is supported in a rearwardly facing, recessed portion 48 of a center bore 50 through the cap (and which is concentric with the inner pipe) so that waste fuel flowing through the inner pipe is discharged as a homogenous stream through the center bore of the cap into the combustion zone 10.

The cap includes a rearwardly protruding tubular skirt 54 which carries an exterior thread that engages a mating interior thread on a forward end 52 of the outer pipe 16. The intermediate pipe 14 terminates short of a rearwardly facing shoulder 56 of the cap. The axial distance between the downstream end of the intermediate pipe and the cap shoulder is spanned by a bushing 58 which is also threaded onto the interior thread on the forward end 52 of the outer pipe. Lastly, a tubular shield 60 is radially spaced from both the inner pipe 12 and the outer pipe 16, as well as from skirt 54 of the cap, and spans the axial distance between a downstream end 62 of the bushing and the cap 6. Thus, the bushing and the tubular shield effectively extend the annular space 38 between the inner pipe 12 and the intermediate pipe 14 in a forward direction from the forward end 63 of the intermediate pipe to the cap.

Bushing 58 includes a rearwardly facing annular section 64 which extends into and blocks off the annular space 34. The bushing defines high velocity primary fuel passages 65, typically in the form of holes from the annular space 34 to an annular chamber 68 between shield 60 and cap skirt 54. Preferably, each high velocity fuel passage 65 is defined by a relatively small diameter hole 66 which extend forwardly from annular space 34 through the annular section 64 of the bushing, an intermediate, annular fuel atomization space 67 between a reduced diameter section 69 of the bushing and the outer pipe 16, and inwardly converging apertures 71 which communicate the atomization space with chamber 68.

Bushing 58 also includes a plurality of circumferentially spaced apart, radially oriented steam bores on passages 70 which communicate the annular space 38, and its forward extension to nozzle cap 6, with atomization space 67. The steam bores are arranged relative to the primary fuel holes 66 so that steam travelling through the bores impinges on primary fuel discharged by the holes and atomize it.

A plurality of spaced apart, atomized primary fuel discharge openings 72 extend through the cap and communicate the downstream side of the cap with the chamber 68. The discharge openings are concentrically arranged relative to the center bore 50 of the cap so that atomized primary fuel is discharged concentrically about the waste fuel discharged from the center bore and, upon ignition of the primary fuel, forms a tubular flame which envelopes the discharged waste fuel. Depending on the relative fuel volumes discharged by the nozzle, the character of the fuels, etc. the discharge openings for the primary fuel may be parallel to the axis of the burner or, more typically they slightly diverge in a downstream direction to take account of the expanding, atomized waste fuel.

The nozzle cap 6 also includes a plurality of equally spaced and concentrically located steam discharge holes 74 which fluidly communicate the downstream extension of annular space 28 (through which the atomizing steam flows) with the downstream side of the cap and thereby with the combustion zone 10. The steam discharge holes are oriented to impinge the discharged steam on the waste fuel stream discharged through center bore 50 so that the latter is atomized just downstream and exteriorly of the nozzle and within the above described tubular, enveloping primary fuel flame.

The operation of the nozzle should now be apparent. To briefly summarize it, waste fuel, which may include particulates of a size up to about the inside diameter of inner pipe 12 so long as the particles can pass therethrough, flows under pressure in a downstream direction through the inner pipe and is discharged into the combustion zone through center bore 50 of nozzle cap 6 as an essentially homogenous stream. The inner pipe diameter and especially the diameter of its discharge end, the temperature and/or the pressure of the waste fuel are selected so that the fuel is discharged at the desired rate and at a sufficient velocity to carry it well into the combustion zone and to enable its atomization.

Steam flows in a downstream direction through annular space 38 and is divided into two steam flow branches at atomizing unit 8. A first branch continues through the downstream extension of annular space 38, past shield 60 and hence through steam discharge holes 74 which converge the steam as discrete jets issuing from the holes onto the waste fuel issuing from the nozzle. The steam jets impinge on the waste fuel and atomize it. This expands the diameter of the atomized waste fuel stream as it propagates into the combustion zone.

Primary fuel flowing through annular space 34 between the intermediate and outer pipes 14, 16 is atomized in atomization space 67 by the second steam branch flow travelling radially outward through the steam passages 70 in bushing 58. The atomized primary fuel enters annular chamber 68 and hence passes through primary fuel discharge openings 72 in cap 6 into the combustion zone. The annular space may be fitted with a sleeve 76 which is shaped to enhance the atomized fuel flow through the atomizing unit. Such flow directing sleeves are wellknown in the art and their construction is not further described herein.

Atomized primary fuel issuing from openings 72 in the cap is ignited immediately downstream of the cap and forms a generally tubular flame that diverges in a downstream direction and which envelopes the atomized waste fuel. Intense, inwardly directed heat radiation generated by the primary fuel flame rapidly heats the atomized waste fuel. This substantially instantaneously drives off and ignites any volatiles that may be present in the waste fuel, thereby liberating additional heat. This latter heat, together with the radiant heat rapidly raises the temperature of the droplets of the remaining waste fuel to their ignition temperature, thereby igniting the atomized waste fuel. All this is accomplished in a minimum of space which in turn minimizes the heat energy required for bringing the waste fuel to its ignition temperature.

It is presently contemplated that the nozzle of the present invention will find primary usage in connection with the firing waste fuels, either to incinerate and thereby dispose of them or as a relatively low cost source of heat energy. However, it can also have other applications. For example, it can be used for simultaneously firing a burner with two fuels which are incompatible and cannot be mixed, a situation that is sometimes encountered in chemical processing plants.

Further, the nozzle of the present invention can also be operated with a single fuel only during times when, for example, no waste fuel is available. In such a case, an adaptor 78 (shown in phantom lines) may be threaded onto the exterior thread on the forward portion of cap 6. The adaptor includes a slanted sealing surface 80 which closes primary fuel discharge openings 72 so that during operation of the nozzle the single fuel is discharged through cap center bore 50 while steam is prevented from escaping through the openings. Alternatively, the adaptor can be constructed so that it closes off the center bore 50 through the cap while permitting the discharge of atomized fuel through openings 72. In such an event, the adaptor (not shown) has a generally cylindrical configuration and is bolted against the downstream face of the cap or center bore 50 may be threaded (not shown) to receive a corresponding threaded extension (not shown) of the adaptor.

To further facilitate the maintenance, cleaning and/or exchange of waste fuel center pipe 12 without having to remove the nozzle from the burner, radial support lugs 44 are preferably welded onto the inner pipe and slidably engage the inside surface of the intermediate pipe 14 while the forward end of the pipe is slidably received within recess 48 of center bore 50. When so constructed the inner pipe can be withdrawn from the nozzle by unthreading plug 26 at the aft end 18 of the nozzle and axially withdrawing the pipe together with the plug in a rearward direction. When withdrawn the inner pipe can be readily cleansed, blocking particles can be removed or it can be replaced with a pipe size for use with a different waste fuel having, for example, a differing viscosity.

I claim:

1. A nozzle for the simultaneous atomization of first and second liquid fuels comprising first and second conduits for independently flowing the first and second fuels, respectively, towards a discharge end of the nozzle, a third conduit for flowing a pressurized fuel atomizing medium towards the discharge end, means fluidly connected with the third conduit defining first and second passages for flowing first and second streams of the medium from the third conduit, first atomizing means in fluid communication with the first passage for contacting the first fuel with the first medium stream so that the first medium stream causes the atomization of the first fuel outside the nozzle, and second atomizing means in fluid communication with the second passage for contacting the second fuel with the second medium stream so that the second medium stream causes the atomization of the second fuel within the nozzle and prior to its discharge therefrom.

2. A nozzle according to claim 1 wherein the first fluid is discharged into a combustion zone, and wherein the first atomization means comprises means for contacting the first fuel with the first medium stream after the former has been discharged from the discharge end of the nozzle.

3. A nozzle according to claim 2 including an opening in fluid communication with the second conduit for discharging the second fuel into the combustion zone, and wherein the second atomization means is arranged to establish contact between the second fuel and the second medium stream upstream of the opening.

4. A nozzle according to claim 3 wherein the opening comprises a plurality of openings arranged to discharge the second fuel in substantially concentric and surrounding relationship to the first fuel discharged into the combustion zone so that heat liberated during the combustion of the second fuel radiates inwardly and thereby heats the discharged first fuel, thereby facilitating its vaporization and combustion.

5. A nozzle according to claim 4 wherein the openings are defined by a plurality of spaced apart orifices arranged generally concentrically with respect to the first fuel issuing from the discharge end of the nozzle.

6. A nozzle for simultaneously atomizing first and second liquid fuels and for discharging such fuels into a zone for their combustion therein, the nozzle comprising first and second conduits for flowing the respective fuels; cap means defining a discharge end of the nozzle and including first and second opening for the discharge of the fuels from the nozzle into the combustion zone; a third conduit for flowing a pressurized medium adapted to atomize the fuels when contacted therewith; means in fluid communication with the third conduit defining a first passage to flow a portion of the medium past the cap means so that the medium portion contacts the first fuel downstream of the corresponding opening in the cap means for atomizing the first fuel downstream of the discharge end and outside the nozzle; means in fluid communication with the third conduit defining a second passage arranged for contacting another portion of the medium with the second fuel at a point upstream of the cap means for atomizing the second fuel within the nozzle; and means defining a flow path for directing atomized second fuel to the second opening for the discharge of the atomized second fuel from the second opening into the combustion zone, the second opening being arranged so that the discharged second fuel is in relatively close proximity to the discharged first fuel; whereby the combustion of the second fuel causes a heating of the discharged first fuel to facilitate the vaporization and combustion of the latter.

7. A nozzle according to claim 6 wherein the first and second conduits are concentrically arranged with respect to each other.

8. A nozzle according to claim 7 wherein the second conduit surrounds the first conduit.

9. A nozzle according to claim 8 wherein the first, second and third conduits are concentrically arranged relative to each other.

10. A nozzle according to claim 9 wherein the third conduit surrounds the first conduit and the second conduit surrounds the third conduit, and wherein the means defining the first passage include means diverging the portion of the fluid medium towards a centerline of the conduit and the means forming the second passage comprises means diverging the other portion of the medium in a radially outward direction into contact with the second fuel.

11. A nozzle according to claim 6 wherein the first fuel comprises a fuel having a higher viscosity than the second fuel, and wherein the first opening comprises a single hole in the cap means arranged concentric relative to the first conduit for the discharge of the first fuel as a unitary stream; and wherein the means defining the first passage includes means defining a plurality of substantially equally spaced apertures extending through the cap means and terminating in discharge orifices arranged concentrically with respect to the first conduit and converging towards the first fuel steam discharged from the first opening.

12. A nozzle according to claim 6 including means demountably secured to the nozzle for optionally closing one of the first and second opening to permit the operation of the nozzle with a single fuel.

13. A nozzle for the simultaneous atomization of a first liquid fuel being relatively difficult to ignite and a second liquid fuel being relatively easy to ignite comprising in combination: a nozzle body defining concentric first, second and third conduits; means for connecting the first, second and third conduits with respective sources of a pressurized first fuel, a pressurized second fuel and a pressurized fuel atomizing medium; a nozzle cap defining a discharge end of the nozzle including means for securing the cap to the body, the cap including a first opening aligned with and in fluid communication with the first conduit, a plurality of second openings in fluid communication with the second conduit, and plurality of third openings in fluid communication with the third conduit; means definig fluid-tight barriers on an upstream side of the cap between the first, second and third openings, the third openings terminating in orifices on a downstream side of the cap oriented to direct fluid medium discharged by them into contact with the first fuel discharged from the first opening to thereby effect the atomization of the first fuel exteriorly and downstream of the nozzle cap; means disposed within the nozzle for diverting a portion of the fulid medium flowing through the third conduit in a generally radially outward direction into contact with the second fuel so that the second fuel is atomized interiorly of the nozzle; and means for directing the atomized second fuel to the second openings for discharge therefrom, the second opening being arranged substantially concentrically about the first and second openings so as to form a generally tubular flame downstream of the nozzle cap enveloping the first fuel discharged from the nozzle whereby heat from the flame formed with the second fuel heats the first fuel, facilitates the vaporization of the first fuel and thereby facilitates the combustion of the relatively difficult to ignite first fuel.

* * * * *